US009069302B2

(12) United States Patent
Samei et al.

(10) Patent No.: US 9,069,302 B2
(45) Date of Patent: Jun. 30, 2015

(54) FIXING DEVICE AND IMAGE FORMING APPARATUS INCLUDING SAME

(71) Applicants: Masahiro Samei, Osaka (JP); Takumi Waida, Kanagawa (JP); Hiroshi Ono, Tokyo (JP); Takeshi Yamamoto, Kanagawa (JP); Ippei Fujimoto, Kanagawa (JP); Hiroshi Seo, Kanagawa (JP); Yasunori Ishigaya, Kanagawa (JP); Kazuhito Kishi, Kanagawa (JP); Ryota Yamashina, Kanagawa (JP)

(72) Inventors: Masahiro Samei, Osaka (JP); Takumi Waida, Kanagawa (JP); Hiroshi Ono, Tokyo (JP); Takeshi Yamamoto, Kanagawa (JP); Ippei Fujimoto, Kanagawa (JP); Hiroshi Seo, Kanagawa (JP); Yasunori Ishigaya, Kanagawa (JP); Kazuhito Kishi, Kanagawa (JP); Ryota Yamashina, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/167,121

(22) Filed: Jan. 29, 2014

(65) Prior Publication Data

US 2014/0219672 A1 Aug. 7, 2014

(30) Foreign Application Priority Data

Feb. 7, 2013 (JP) ..... 2013-022326
Dec. 18, 2013 (JP) ..... 2013-261337

(51) Int. Cl.
*G03G 15/20* (2006.01)

(52) U.S. Cl.
CPC .... *G03G 15/2039* (2013.01); *G03G 2215/2035* (2013.01)

(58) Field of Classification Search
USPC ..... 399/38, 67–70, 122, 320, 328, 329; 219/216, 619
See application file for complete search history.

(56) References Cited

U.S. PATENT DOCUMENTS 5,402,211 A * 3/1995 Yoshikawa ..... 399/331
5,819,134 A * 10/1998 Sato et al. ..... 399/69
2002/0085851 A1* 7/2002 Murata et al. ..... 399/69

FOREIGN PATENT DOCUMENTS

JP 6-095540 4/1994
JP 9-096991 4/1997
JP 2001-343860 12/2001
JP 2005-181946 7/2005

OTHER PUBLICATIONS

U.S. Appl. No. 14/161,078, filed Jan. 22, 2014.
U.S. Appl. No. 14/173,171, filed Feb. 5, 2014.
U.S. Appl. No. 14/174,134, filed Feb. 6, 2014.

* cited by examiner

*Primary Examiner* — Hoan Tran
(74) *Attorney, Agent, or Firm* — Oblon, McClelland, Maier & Neustadt, L.L.P.

(57) ABSTRACT

A fixing device includes a fixing rotary body, an opposed member, a heater, and a heating controller. The opposed member opposes the fixing rotary body to form a nipping portion therebetween. The heater includes heat generators arranged in a width direction of a recording medium. When the recording medium fed to the nipping portion has an image area and a non-image area, the heating controller controls the outputs of the heat generators based on image information so that a first heat generator of the heat generators corresponding to the image area is higher in temperature and a second heat generator of the heat generators corresponding to the non-image area is lower in temperature. Based on information other than the image information, the heating controller temporarily shifts an area of the fixing rotary body corresponding to the non-image area to a temperature differing from a normal temperature.

9 Claims, 16 Drawing Sheets

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2013-022326, filed on Feb. 7, 2013, and 2013-261337, filed on Dec. 18, 2013, in the Japan Patent Office, the entire disclosure of each of which is hereby incorporated by reference herein.

BACKGROUND

1. Technical Field

Embodiments of the present invention relate to a fixing device to fix an image on a recording medium and an image forming apparatus including the fixing device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such electrophotographic image forming apparatuses may have a fixing device to fix a toner image on a sheet of paper serving as a recording medium.

Such a fixing device includes, for example, a fixing rotary body heated by a heating member and an opposed member to contact the fixing rotary body. The fixing rotary body and the opposed member contact each other to form a nipping portion. When a sheet having a toner image passes through the nipping portion, toner is fused under the heat of the fixing rotary body and fixed on the sheet.

Typically, such a heating member heats the fixing rotary body over an entire width of the sheet passing the nipping portion. As a result, the entire sheet is heated by the fixing rotary body. However, when an image is placed on only a portion of the sheet, heat energy is wasted in a non-image area, i.e., an area having no image.

To reduce such waste of heat energy in the non-image area, for example, JP-2001-343860-A proposes a fixing device using, as an external heater, a thermal heater in which heaters are arranged at even spaces in the width direction of a sheet (see paragraph [0051] and FIGS. 11 and 12). By controlling each heater in accordance with image information, the fixing device adjusts a heating area in accordance with the distribution of an image area and a non-image area on a recording medium to heat the image area without heating the non-image area.

As described above, for the fixing device that adjusts the heating area in response to the distribution of an image area and a non-image area in an image, typically, the non-image area is maintained at a default constant temperature. However, such a configuration imposes a limitation on the effect obtained by the heating member that includes plural heaters arranged in the width direction of a sheet. The heating member thus configured has a potentiality to further enhance the multifunctionality of a fixing device.

BRIEF SUMMARY

In at least one embodiment of this disclosure, there is provided a fixing device including a fixing rotary body, an opposed member, a heater, and a heating controller. The opposed member opposes the fixing rotary body to form a nipping portion between the opposed member and the fixing rotary body. The heater heats the fixing rotary body. The heater includes plural heat generators arranged in a width direction of a recording medium fed to the nipping portion. The heating controller separately controls outputs of the heat generators. When the recording medium fed to the nipping portion has an image area and a non-image area, the heating controller controls the outputs of the heat generators based on image information so that a first heat generator of the heat generators corresponding to the image area is higher in temperature and a second heat generator of the heat generators corresponding to the non-image area is lower in temperature. Based on information other than the image information, the heating controller temporarily shifts an area of the fixing rotary body corresponding to the non-image area to a temperature differing from a normal temperature.

In at least one embodiment of this disclosure, there is provided an image forming apparatus including the above-described fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
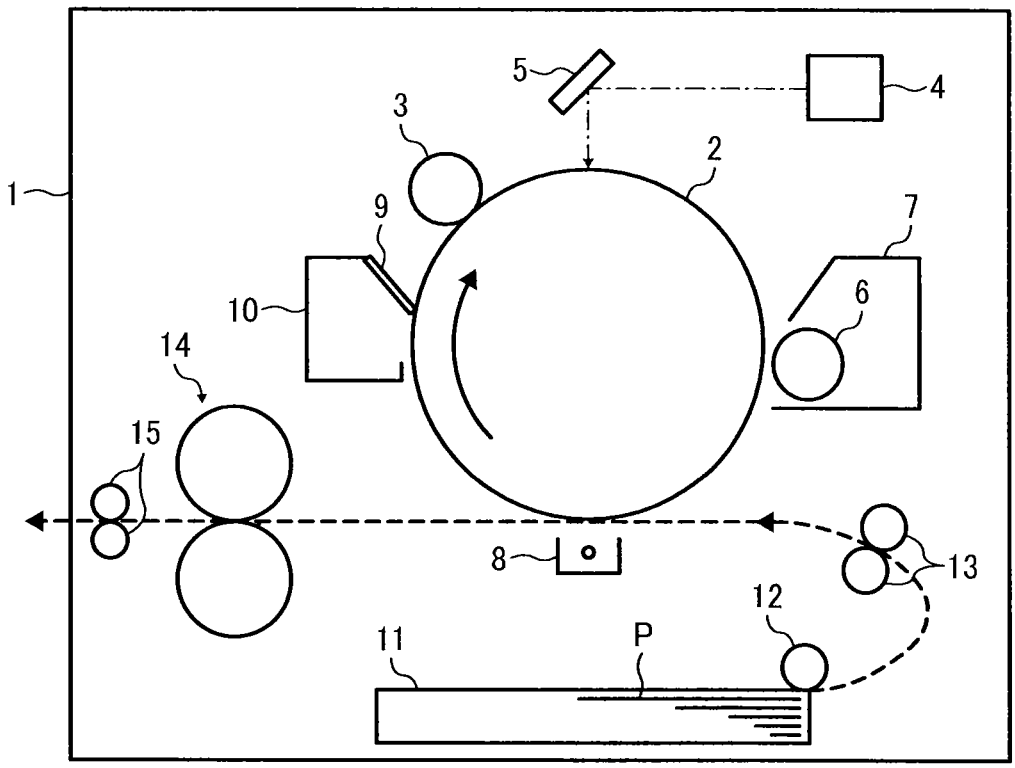
FIG. 1 is a schematic view of an image forming apparatus according to embodiments of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the invention and all of the components or elements described in the embodiments of this disclosure are not necessarily indispensable to the present invention.

With reference to attached drawings, embodiments of the present invention are described below. In the drawings for explaining the following embodiments, the same reference codes are allocated to elements (members or components) having the same function or shape and redundant descriptions thereof are omitted below.

FIG. 1 is a schematic view of an image forming apparatus according to an embodiment of the present invention.

The image forming apparatus illustrated in FIG. 1 is a monochromatic image forming apparatus, and includes a photoreceptor 2 serving as an image carrier in a middle of an apparatus body 1. The image forming apparatus illustrated in FIG. 1 is a monochromatic image forming apparatus, and includes a photoreceptor 2 serving as an image carrier in a middle of an apparatus body 1. The photoreceptor 2 is surrounded by a charging roller 3, a light source 4, a mirror 5, a development unit 7, a transfer unit 8, and a cleaner 10. The charging roller 3 serves as a charger, and the light source 4 and the mirror 5 constitute an exposure unit. The development unit 7 has a development roller 6, and the cleaner 10 has a cleaning blade 9.

The apparatus body 1 includes a feed tray 11, a feed roller 12, paired registration roller 13, a fixing device 14, and paired output rollers 15. The feed tray 11 stores sheets P serving as recording media, and the feed roller 12 feeds the sheets P from the feed tray 11. The paired registration rollers 13 serve as timing rollers, and the fixing device 14 fixes images on the sheets P. The output rollers 15 discharge the sheets P to the outside of the apparatus body 1. Examples of the recording media include plain paper sheets, cardboards, envelopes, thin paper sheets, coated paper sheets, tracing paper sheets, and overhead projector (OHP) sheets. In some embodiments, a bypass feed unit or manual feed unit may be provided with the apparatus body 1.

Next, a basic operation of the image forming apparatus according to the present embodiment is described with reference to FIG. 1.

When imaging operation is started, a driving device drives the photoreceptors 2 to rotate clockwise in FIG. 1, and the charging roller 3 uniformly charges an outer surface of the photoreceptors 2 at a predetermined polarity. Based on image information from, e.g., an image reading device or a computer, exposure light L emitted from the light source 4 is scanned via the mirror 5 and irradiated onto the charged surface of the photoreceptor 2. As a result, an electrostatic latent image is formed on the surface of the photoreceptor 2. When the development roller 6 supplies toner to the electrostatic latent image, the electrostatic latent image is visualized (becomes visible) as a toner image.

On the other hand, when imaging operation is started, the feed roller 12 starts rotation to separate and feed the sheets P sheet by sheet from the feed tray 11. The registration rollers 13 temporarily stop the sheet P and correct a displacement from a proper position. The registration rollers 13 are rotated in synchronization with the rotation of the photoreceptor 2 to feed the sheet P so that a leading end of the toner image on the photoreceptor 2 matches a predetermined position of a leading end of the sheet P in a sheet feed direction. Thus, the toner image on the photoreceptor 2 is transferred onto the sheet P by a transfer electric field generated by the transfer unit 8. After the transfer of the toner image, the sheet P is fed to the fixing device 14, and the fixing device 14 fixes the toner image on the sheet P. The output rollers 15 discharge the sheet P to the outside of the apparatus body 1.

With rotation of the photoreceptor 2, residual toner remaining on the photoreceptor 2 without being transferred on the sheet P is carried to the cleaning blade 9 and scraped off by the cleaning blade 9. The surface of the photoreceptor 2 is diselectrified by a diselectrification device for preparation of the next imaging process.

Figure 2:
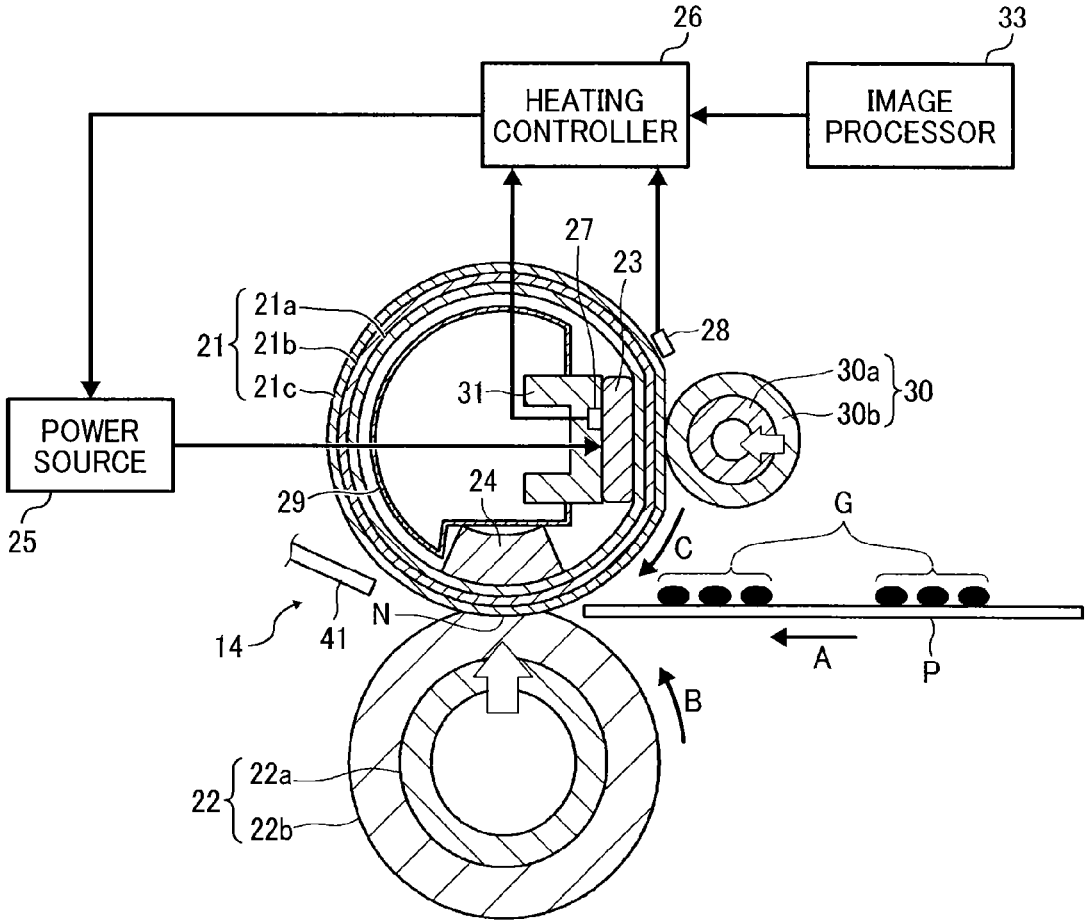
FIG. 2 is a cross-sectional view of a fixing device according to an embodiment of the present invention.

FIG. 2 is a cross sectional view of a basic configuration of a fixing device 14 according to embodiments of this invention.

As illustrated in FIG. 2, the fixing device 14 includes, e.g., a fixing belt 21, a pressure roller 22, and a heater 23. The fixing belt 21 serves as a fixing rotary body. The pressure roller 22 serves as an opposed member (or opposed rotary body) to contact the fixing belt 21 to form a nipping portion N. The heater 23 serves as a heating unit to heat the fixing belt 21.

The fixing belt 21 is formed of a thin, flexible belt (or film) member having an endless shape. For example, the fixing belt 21 includes a substrate 21*a*, an elastic layer 21*b*, and a release layer 21*c*. The substrate 21*a* includes stainless steel (SUS) and has an outer diameter of approximately 40 mm and a thickness of approximately 40 mm. The elastic layer 21*b* includes silicone rubber, has a thickness of approximately 100 μm, and coats an outer circumferential surface of the substrate 21*a*. The release layer 21*c* includes fluorine resin, such as perfluoro-alkoxyalkane (PFA) or polytetrafluoroethylene (PTFE), has a thickness of approximately 5 μm to approximately 50 μm, and coats an outer circumferential surface of the elastic layer 21*b*. The substrate 21*a* of the fixing belt 21 may include resin material, such as polyimide.

The pressure roller 22 includes a core metal 22*a* and an elastic layer 22*b*. The core metal 22*a* includes, e.g., iron and has an outer diameter of 40 mm and a thickness of 2 mm. The elastic layer 22*b* coats an outer circumferential surface of the core metal 22*a*. The elastic layer 22*b* of the pressure roller 22 includes, e.g., silicone rubber and has a thickness of 5 mm. In some embodiments, to enhance the releasability (i.e., facilitate a sheet P to release from the pressure roller 22), a release layer including fluorine resin may be formed at a thickness of 40 μm on an outer circumferential surface of the elastic layer 22*b*.

At an inner circumferential side of the fixing belt 21, a nip formation member 24 is disposed at a position opposing the pressure roller 22. The nip formation member 24 has opposed ends supported by side plates of the fixing device 14. The pressure roller 22 is pressed against the nip formation member 24 by a pressing unit, such as a pressing lever, to form the nipping portion N having a desired width at a pressure contact portion between the fixing belt 21 and the pressure roller 22. Alternatively, in some embodiments, the fixing rotary body and the opposed member may simply contact each other without being pressed by such a pressing unit.

The pressure roller 22 is driven by a driving source, e.g., motor, to rotate in a direction indicated by arrow B in FIG. 2. When the pressure roller 22 is driven for rotation, the driving force is transmitted from the pressure roller 22 to the fixing belt 21 at the nipping portion N. As a result, with the rotation of the pressure roller 22, the fixing belt 21 is rotated in a direction (belt rotation direction) indicated by arrow C in FIG. 2. At the inner circumferential side of the fixing belt 21, a belt support member 29 is disposed to support the fixing belt 21.

The heater 23 includes sheet-shaped or plate-shaped heat generators, such as thermal heaters or ceramic heaters. At the inner circumferential side of the fixing belt 21, a stay 31 serving as a support member is disposed. The stay 31 supports the heater 23 at a position upstream from the nipping portion N in a sheet feed direction indicated by arrow A in FIG. 2 so that the heater 23 opposes an inner circumferential face of the fixing belt 21. The power source 25 is connected to the heater 23 to supply electric power to the heater 23. A heating controller 26 controls output of the power source 25. The heating controller 26 is formed of, e.g., a microcomputer including a central processing unit (CPU), a read-only memory (ROM), a random access memory (RAM), an input/output (I/O) interface, and so forth.

The fixing device 14 has a first sensor 27 serving as a heater-temperature detector to detect the temperature of the heater 23 and a second sensor 28 serving as a belt-temperature detector to detect the temperature of the fixing belt 21. The first sensor 27 is disposed to directly contact the heater 23. The second sensor 28 is disposed to oppose an outer circumferential surface of the fixing belt 21 at a position upstream from the heater 23 in the belt rotation direction indicated by arrow C in FIG. 2. Information on temperatures detected by the first sensor 27 and the second sensor 28 is input to the heating controller 26. The heating controller 26 is configured to control the output of the power source 25 in accordance with the input information.

A pushing roller 30 serving as a pushing member to apply pressure to the fixing belt 21 is disposed at a position opposing the heater 23 at the outer circumferential side of the fixing belt 21. The pushing roller 30 presses the fixing belt 21 from the outer circumferential side of the fixing belt 21 toward the heater 23, so that the fixing belt 21 contacts the heater 23. The pushing roller 30 has an outer diameter of approximately 15 mm to approximately 30 mm, and includes a core metal 30*a* and an elastic layer 30*b* coating an outer circumferential surface of the core metal 30*a*. The core metal 30*a* has an outer diameter of approximately 8 mm. The elastic layer 30*b* includes silicone rubber and has a thickness of approximately 3.5 mm to approximately 11 mm. In addition, to enhance the releasability, a release layer including fluorine resin may be formed at a thickness of approximately 40 μm on the elastic layer 30*b*. In this embodiment, the pushing roller 30 is pressed against the fixing belt 21 by a pressing unit. In some embodiments, for example, the pushing roller 30 may contact the fixing belt 21 without being pressed by such a pressing unit.

Next, a basic operation of the fixing device according to this embodiment is described with reference to FIG. 2.

When a power switch of the apparatus body 1 is turned on, the power source 25 supplies electric power to the heater 23 and the pressure roller 22 starts rotating in the direction indicated by arrow B in FIG. 2. By the friction force generated between the fixing belt 21 and the pressure roller 22, the fixing belt 21 is driven to rotate in the belt rotation direction indicated by arrow C in FIG. 2.

When a sheet P bearing an unfixed toner image G after the imaging process is fed to the nipping portion N between the fixing belt 21 and the pressure roller 22, the sheet P is heated and pressed. As a result, the toner image G is fixed on the sheet P. Then, the sheet P is fed from the nipping portion N and discharged to the outside of the apparatus body 1.

Below, the configuration of the fixing device 14 according to this embodiment is further described.

Figure 3:
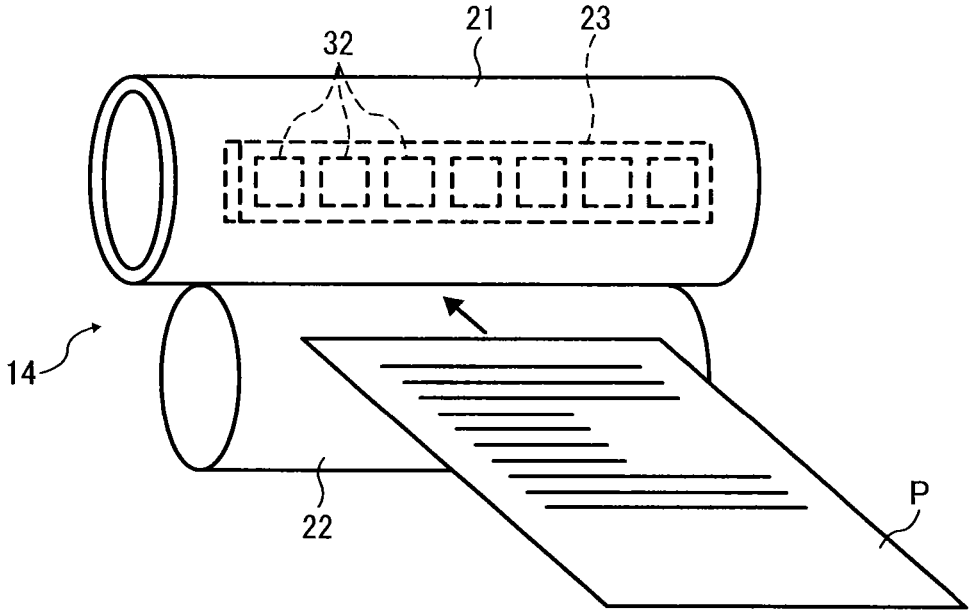
FIG. 3 is a partial perspective view of a fixing device according to an embodiment of the present invention.

As illustrated in FIG. 3, the heater 23 serving as heating member includes multiple heat generators 32 (e.g., nine in FIG. 3) arranged at even spaces in the width direction perpendicular to the feed direction of the sheet P. The heat generators 32 are connected to the power source 25 in such a manner that the power source 25 can separately supply power to the respective heat generates 32. As a result, powers supplied to the heat generators 32 are controlled independent of each other by the heating controller 26. Thus, the outputs of the heat generators 32 can be controlled independent of each other.

For example, the heating controller 26 selects one or more heat generators 32 to be activated from the heat generators 32 to adjust a heating range in the width direction of the sheet, controls timings of turning the heat generators 32 ON and OFF to adjust a heating range in a rotation direction, and controls the amount of heat generation of the heat generators 32 to adjust the amount of heat generation per unit time (heating temperature). The heating controller 26 controls the amount of heat generation (output) of the heat generators 32 by changing the power supplied to the respective heat generators 32. Supplied power is changed by adjusting the voltage in analog manner or turning-on duty (the rate of turning-on time in certain time).

Image signals transmitted from an image reading device of the image forming apparatus or an external device are input to an image processor 33, and the image processor 33 performs image processing on the input signals. Image information from the image processor 33 is input into the heating controller 26, and the heating controller 26 controls the outputs of the heat generators 32 via the power source 25 in accordance with the image information.

Figure 4A:
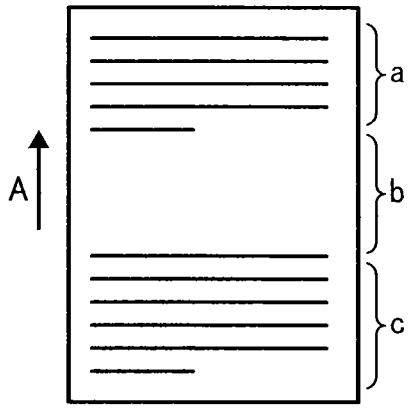
FIGS. 4A to 4C are plan views of examples of image formation patterns.

For example, as illustrated in FIG. 4A, when an image area "a", a non-image area "b", and an image area "c" are formed in this order from the leading side of the sheet P in the sheet feed direction A, preferably, fixing is performed on the image area "a" and "c", not on the non-image area "b". In such a case, based on image information, the heating controller 26 controls the heater 23 so that the temperature of a portion of the fixing belt 21 corresponding to the non-image area "b" is lower than the temperatures of other portions of the fixing belt 21 corresponding to the image areas "a" and "c". In other words, in such a case, at the portions corresponding to the image areas "a" and "c", power is supplied to all of the heat generators 32 in a normal way. By contrast, at the portion corresponding to the non-image area "b", the power supplied to all of the heat generators 32 is reduced or stopped. As described above, reducing or stopping the power supplied to the heat generators 32 at the portion corresponding to the non-image area "b" allows a reduction in waste consumption of heat energy at the non-image area "b".

Figure 4B:
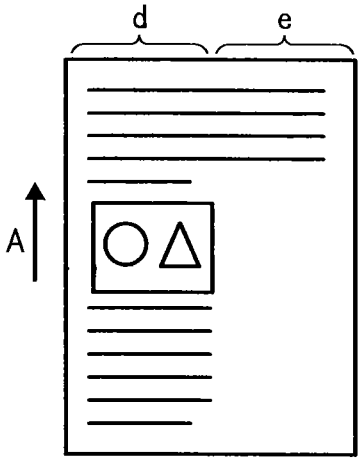

As illustrated in FIG. 4B, when both an image area "d" and an image area "e" exist in the width direction of the sheet P, the heating controller 26 controls the power source 25 to reduce or stop the power supplied to one or more of the heat generators 32 disposed at a position (on the right side in FIG. 4B) corresponding to the non-image area "e". Thus, waste consumption of heat energy at the non-image area "e" can be reduced.

Figure 4C:
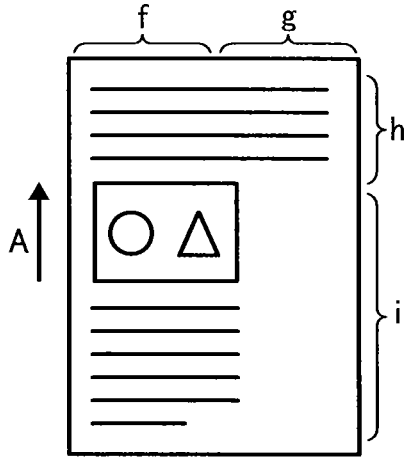

In an example illustrated in FIG. 4C, both an image area and a non-image area are mixed in both the width direction and the conveyance direction of the sheet P. In such a case, at a portion corresponding to a non-image area formed in an area in which a range "g" and a range "i" overlap each other, the power supplied to the heat generators 32 is reduced or stopped. Thus, like the above-described examples, waste consumption of heat energy at the non-image area can be reduced.

Figure 5:
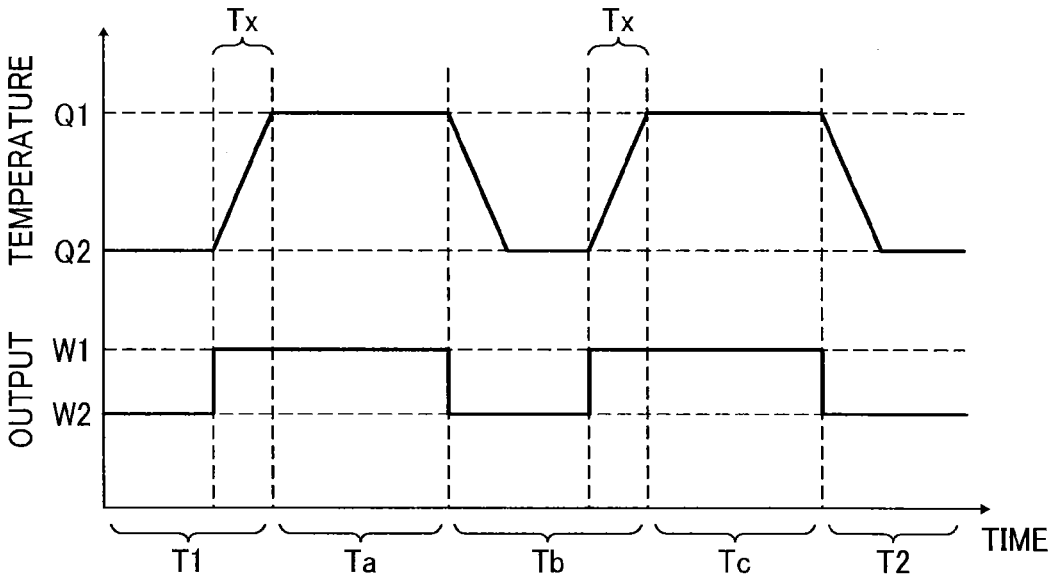
FIG. 5 is a graph of changes in the output of a heater and the temperature of a fixing belt observed when a sheet passes through a nipping portion according to an embodiment of the present invention.

FIG. 5 is a graph of changes in output of the heater 23 and temperature of the fixing belt 21 observed when the sheet illustrated in FIG. 4A passes the nipping portion N. Below, control of the temperature of the fixing belt 21 according to the present embodiment is described with reference to FIG. 5.

As illustrated in FIG. 5, at timings Ta and Tc at which the image areas "a" and "c" of the sheet pass the nipping portion N, the heating controller 26 controls power supplied to the heat generators 32 so that the temperature of the fixing belt 21 reaches a first target temperature Q1 necessary for fixing images. By contrast, at a timing Tb at which the non-image area "b" passes the nipping portion N, the heating controller 26 reduces the power supplied to the heat generators 32 so that the temperature of the fixing belt 21 falls to a second target temperature Q2 lower than the first target temperature Q1, thus reducing waste consumption of heat energy. Here, in time periods Tb, T1, and T2 in which the image areas "a" and "c" do not pass the nipping portion N, the power supplied to the heat generators 32 may be completely stopped. However, if the temperature of the fixing belt 21 extremely falls, it might be difficult to raise the temperature of the corresponding heat generator 32 to the first target temperature Q1 on arrival of an image area of the same or subsequent sheet to the nipping portion N. Hence, like the example shown in FIG. 5, an output W2 lower than an output W1 corresponding to the first target temperature Q1 is set as the output of the heat generators 32. In the time periods Tb, T1, and T2 in which the image areas "a" and "c" do not pass the nipping portion N, preferably, the temperature of the fixing belt 21 is maintained at the second target temperature Q2, which is lower than the first target temperature Q1 but higher than a room temperature, by heating the fixing belt 21 at the lower output W2. The second target temperature Q2 is determined in consideration of the performance of the heater 23, the heat capacity of the fixing belt 21, and so forth.

Generally, it takes a certain heat-up time the temperature of the fixing belt to reach a target temperature after the start of heating the fixing belt. Therefore, even if, on arrival of a leading end of the image area "a" at the nipping portion N, the heat generators 32 start to raise the temperature of the fixing belt 21 at the output W1 corresponding to the first target temperature Q1, the temperature of the fixing belt 21 might not be raised to the first target temperature Q1 in time. Hence, like the example showing in FIG. 5, taking into account the heat-up time of the fixing belt 21, the fixing belt 21 is preferably preheated at the output W1 for a time period Tx before the leading end of each of the image areas "a" and "c" arrives at the nipping portion N. However, from a viewpoint of energy saving, the preheat time Tx is preferably shorter. The heat-up time of the fixing belt 21 varies depending on the heat transmission rate of the fixing belt or the heating length in the rotation direction, and therefore is preferably determined in advance through experiments.

In the example illustrated in FIG. 5, the fixing temperature of each of the image areas "a" and "c" is set to the same temperature (first target temperature Q1). In some embodiments, the first target temperature Q1 may be different between image areas in accordance with the types of images included in the image areas.

For example, when image areas have different image types, such as character, photograph, and diagram, different target temperatures may be set to the respective image areas in accordance with the image types. In particular, when an image area is a photographic image area, it is preferable to increase the glossiness of the image. Hence, by setting a higher first target temperature for the photographic image area, desired glossiness can be obtained.

When image areas have different types of image patterns, such as solid image, halftone image, line image, and character image, or image patterns of image areas are formed by different processing methods, such as dithering methods and error diffusion methods, different first target temperatures Q1 may be set to the respective image areas in accordance with the image patterns or processing methods. In this regard, the degree of isolation or density of toner particles is different between image patterns, and isolated toner particles are more likely to drop off than concentrated toner particles. Hence, a higher first target temperature Q1 is set to an image pattern of isolated toner particles to suppress drop-off of the toner particles. By contrast, a lower first target temperature Q1 is set to an image pattern of concentrated toner particles to reduce consumption energy.

When the adherence amount of toner is different between image areas, the temperature necessary for fixing toner is different between the image areas. Hence, the adherence amount of toner may be determined based on image information to set different first target temperatures Q1 to the respective image areas in accordance with the determined adherence amount of toner. Typically, since an image having a greater adherence amount of toner needs a greater heat amount to fuse toner of the image, the first target temperature Q1 is raised. By contrast, the first target temperature Q1 for an image having a smaller adherence amount of toner is reduced, thus allowing a reduction in consumption energy.

For a color image forming apparatus using a plurality of different color toners, the heat amount necessary for fixing may be different between the colors of toner. In such a case, the target temperature may be set to be different between the colors of toner. For example, black toner is likely to need a smaller heat amount for fixing than any other color, such as yellow, cyan, or magenta. Hence, the target temperature may be reduced for an image area including only black toner, thus reducing consumption energy.

As described above, when the image areas X are heated, the first target temperature Q1 is adjusted in accordance with, for example, the image type, image pattern, processing method of image pattern, adherence amount of toner, and/or toner color. By contrast, when the non-image area Y is heated, the second target temperature Q2 is set as default and basically maintained at a constant temperature (normal temperature).

As described above, the second target temperature Q2 is usually fixed. However, in such a case, various failures may arise. Below, descriptions are given of such failures and embodiments to provide technical means to deal with such failures.

An embodiment of the present invention is described below.

In electrophotographic image forming apparatuses, for example, a failure in the development process or the transfer process may cause toner to be scattered and adhere to a non-image area of a sheet P (background staining). In the fixing process, if such a non-image area is heated at the above-described second target temperature Q2, toner adhering to the non-image area would remain on the sheet P without being fused after the fixing process since the second target temperature Q2 is lower than the first target temperature Q1 for fixing toner. As a result, toner might drop off from the sheet after printing and stain a user's hand or cloth.

Figure 6:
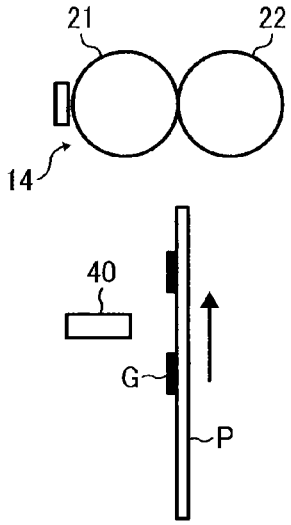
FIG. 6 is a side view of a fixing device and a surrounding area thereof according to an embodiment of the present invention.

To deal with such a challenge, in this embodiment, as illustrated in FIG. 6, an image forming apparatus has an image density sensor 40 serving as image density detector oriented toward a toner adherence face of a sheet P. The image density sensor 40 is disposed between a fixing device 14 and a transfer nipping portion at which a toner image is transferred onto the sheet P serving as a recording medium. The image density sensor 40 detects the adherence amount of toner G on the entire sheet P, and output of the image density sensor 40 is input to the heating controller 26. As an example of the image density sensor 40, for example, a mirror or diffusion reflection type of toner density sensor may be used to scan in the width direction of a sheet P, or such toner density sensors may be arranged along the width direction of a sheet P.

Figure 7:
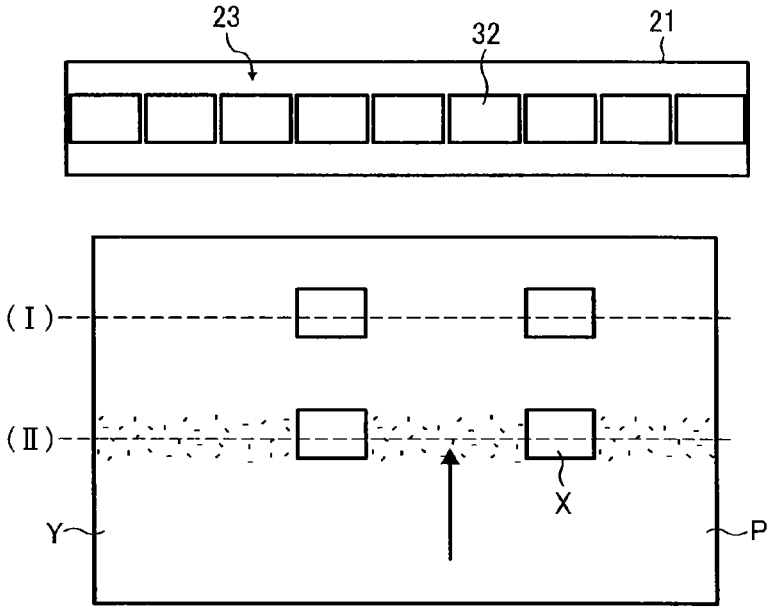
FIG. 7 is a front view of a heater and a plan view of a sheet.

In FIG. 7, relative positions of the heater 23 and a sheet P having image areas X and a non-image area Y are shown. Sensing areas I and II of the image density sensor 40 are indicated by broken lines in FIG. 7. As illustrated in FIG. 7, here, it is assumed that toner is not scattered in the sensing area I and is scattered in the other sensing area II (as indicated by scattered dots).

Figure 8A:
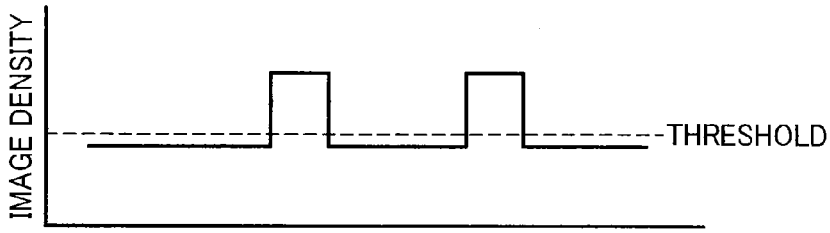
FIGS. 8A and 8B are graphs of detection signals of a sensor.
Figure 8B:
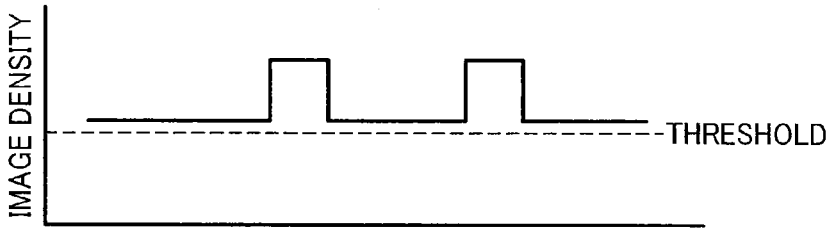

FIGS. 8A and 8B show detection signals in the sensing areas I and II, respectively, illustrated in FIG. 7.

FIG. 8A corresponds to the sensing area I, and FIG. 8B corresponds to the sensing area II. As described above, the detection signal of the sensing area I is greater than a threshold value in the image areas X and is lower than the threshold value in the non-image area Y. By contrast, in the sensing area II, as illustrated in FIG. 8B, the detection signal is greater than the threshold value in any of the image areas X and the non-image area Y. As described above, by sensing that the detection signal of the image density sensor 40 is greater than the threshold value in the non-image area Y, it can be detected that scattered toner causing background staining arises in the non-image areas Y. The threshold value is preferably set so as to be able to detect that the amount of scattered toner is an amount at which a user can recognize that toner has adhered to, e.g., a hand or finger.

Figure 9A:
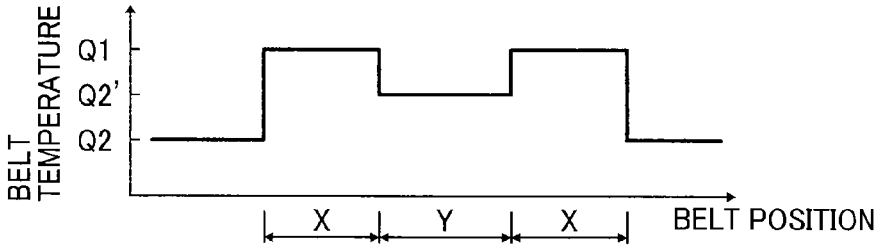
FIGS. 9A and 9B are graphs of temperature distributions of a fixing belt.
Figure 9B:
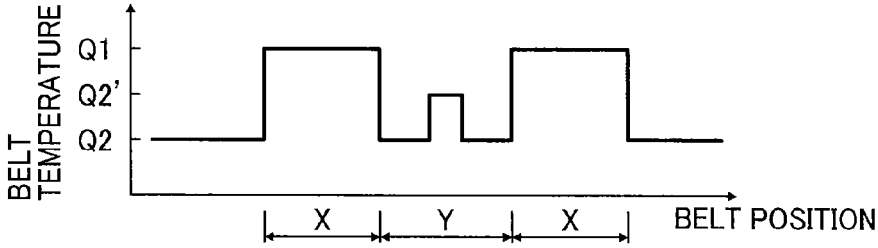

As described above, when scattered toner is detected in the non-image area Y, the heating controller 26 increases the outputs of heat generators 32 to heat the non-image area Y and raises the temperature of an area of the fixing belt 21 corresponding to the non-image area Y to a temperature Q2'. FIGS. 9A and 9B show changes in the temperature of the fixing belt 21 observed when toner is scattered on a portion of the non-image area Y between two image areas X. In FIG. 9A, the non-image area Y including the toner scattered portion is entirely heated to the temperature Q2'. Alternatively, as illustrated in FIG. 9B, only the toner scattered portion of the non-image area Y may be heated to the temperature Q2'. From a viewpoint of energy saving, it is preferable to use a heating mode illustrated in FIG. 9B to raise the temperature of only a minimum required area.

As described above, a toner scattered portion of the non-image area Y is heated by raising the temperature of an area of the fixing belt 21 corresponding to the non-image area Y to a temperature greater than the normal temperature (second target temperature Q2) set as default. Such a configuration allows scattered toner to be fused to adhere to a sheet, thus preventing the above-described failure that may be caused by drop-off of toner after printing. Scattered toner on the image areas X is heated at a fixing temperature and fully fixed on the sheet, thus preventing occurrence of the above-described failure in the image areas X.

Toner particles scattered in the non-image area Y need not necessarily be completely fixed on a sheet, and it is sufficient to heat the toner particles to an extent that a portion of the toner particles are fused to obtain an adhering force enough to prevent toner particles from dropping off from the sheet. As a result, the temperature of the toner scattered portion of the non-image area Y need not necessarily be raised to the fixing temperature like the image areas X, and is sufficient to be raised to a temperature lower than the fixing temperature. Hence, in FIGS. 9A and 9B, the temperature of an area of the fixing belt 21 corresponding to the toner scattered portion of the non-image area Y is raised to the temperature Q2' lower than the first target temperature Q1. It is to be noted that, when loss of heat energy is not so problematic, the temperature of the area of the fixing belt 21 corresponding to the toner scattered portion may be raised to a temperature equivalent to the temperature Q2' of the image areas X.

As described above, in the present embodiment, when the adherence amount of scattered toner is greater than a threshold value, the above-described control is performed. In such a case, as a method of determining whether or not the adherence amount is greater than the threshold value, in FIGS. 8A and 8B, the determination method based on whether or not the detection signal of the image density sensor 40 is greater than the threshold value is shown. It is to be noted that the determination method is not limited to the above-described example and may be any other suitable method. For example, the detection signal of the image density sensor 40 may be compared with image information input to the heating controller 26. In such a case, if toner density is relatively high in the non-image area Y, it can be determined that toner is scattered in the non-image area Y. The above-described heating control can be performed to raise the temperature of all or a part of the non-image area Y.

Figure 17:
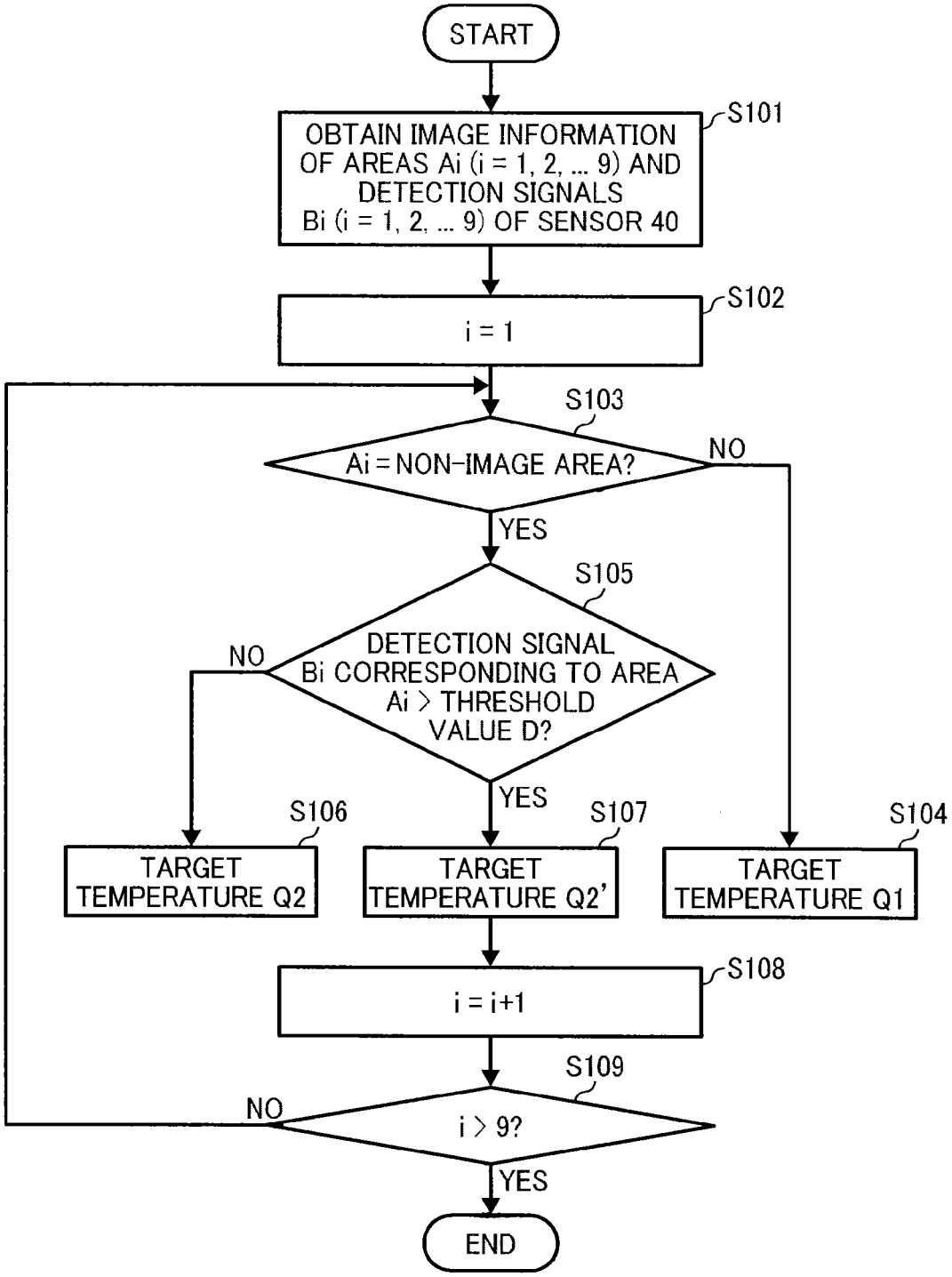
FIG. 17 is a flowchart of an example of control of a belt temperature by comparing a detection signal of an image density sensor with image information according to an embodiment of the present invention.

An example of such a control of the temperature of the fixing belt 21 by comparing the detection signal of the image density sensor 40 with image information is described below with reference to FIG. 17. In this method, a target region of a sheet P is divided into areas heated by heat generators 32. Based on image information, it is determined whether each of the divided areas is an image area X or a non-image area Y.

Then, based on a detection signal of the image density sensor 40, it is determined whether or not toner adheres to the non-image area Y. In the following description, like FIG. 7, nine heat generators 32 serving as heater 23 are arranged in the width direction of a sheet P.

The heating controller 26 obtains image information of areas Ai (i=1, 2, . . . , 9) heated by the respective heat generators 32 and detection signals Bi (i=1, 2, . . . , 9) of the adherence amounts of toner in the areas Ai (i=1, 2, . . . , 9) detected by the image density sensor 40 (S101). Based on image information, first, the heating controller 26 determines whether the area A1 (S102) is an image area X or a non-image area Y (S103). If the area A1 is an image area X (NO at S103), the target temperature of the area A1 is set to Q1 (S104). If the area A1 is a non-image area Y (YES at S103), the heating controller 26 determines whether or not the detection signal B1 of the image density sensor 40 corresponding to the area A1 is greater than a threshold value D (S105). If the detection signal B1 is not greater than the threshold value D (NO at S105), the heating controller 26 sets the target temperature to Q2 (S106). If the detection signal B1 is greater than the threshold value D (YES at S105), the heating controller 26 sets the target temperature to Q2' (S107). Next, for the A2 area incremented by one (S108 and S109), the target temperature is determined in the same steps S103 to S107. Further, the same steps are repeated in turn for the areas A3, 4, . . . , 9 to determine the target temperatures of the respective areas. When the target temperature of the area A9 is determined, the process ends.

Figure 18A:
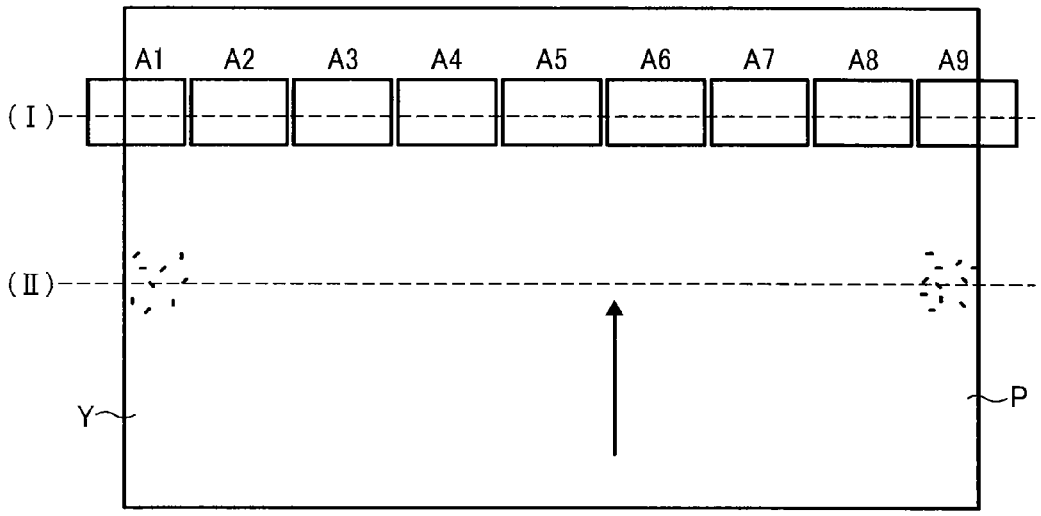
FIG. 18A is a front view of relative positions of areas heated by heat generators and a sheet.
Figure 18B:
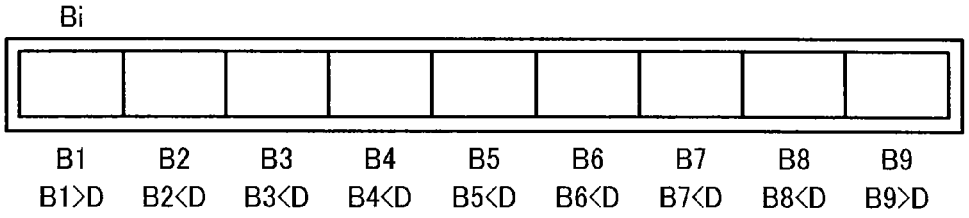
FIG. 18B is a diagram of detection signals of the image density sensor.
Figure 18C:
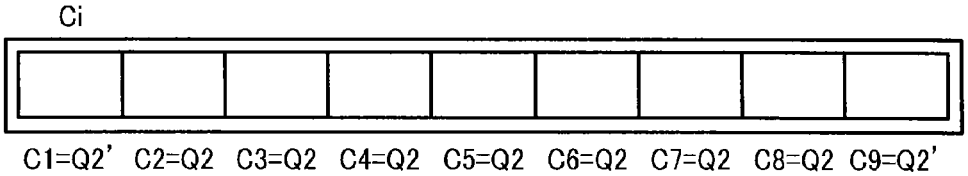
FIG. 18C is a diagram of detection signals of a second sensor.

In the example illustrated in FIG. 18A, in the non-image area Y heated by the nine heat generators 32, toner is scattered on only the areas A1 and A9 at both ends in the width direction of a sheet. In such a case, as illustrated in FIG. 18B, any of the detection signals B1 and B9 of the image density sensor 40 at the areas A1 and A9 at both ends is greater than the threshold value D, and any of the detection signals at the other areas A2 to A8 is not greater than the threshold value D. As a result, the target temperature of each of the areas A1 and A9 at both ends is set to Q2', and the target temperature of each of the other areas A2 to A8 is set to Q2. As illustrated in FIG. 18C, for the respective areas Ai (i=1, 2, . . . , 9), the heating controller 26 controls the respective heat generators 32 so that temperatures Ci (i=1, 2, . . . , 9) detected by the second sensor 28 become the target temperatures.

Next, another embodiment of the present invention is described below.

In a case in which a less-stiff, thin sheet of paper is used as a sheet P, the separability may be reduced when the sheet P having passed through the nipping portion N is separated from the fixing belt 21 by the separation member 41 (see FIG. 2), such as separation pawl. As a result, the sheet P might be caught on the separation member 41 or wound around the fixing belt 21, thus causing a sheet jam. The occurrence of such a separation error of a sheet depends on the sheet type, environmental temperature or humidity, and so on.

Figure 10A:
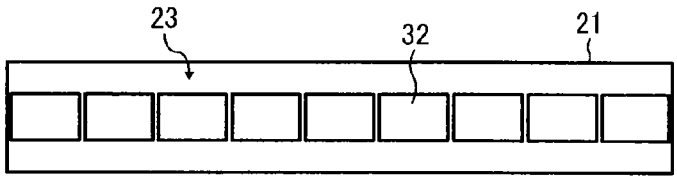
FIG. 10A is a front view of a heater according to an embodiment of the present invention.
Figure 10B:
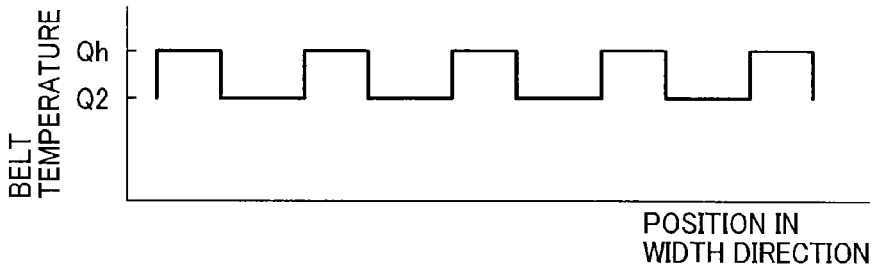
FIG. 10B is a chart of a temperature distribution of an area of a fixing belt corresponding to a leading end portion of a sheet.
Figure 10C:
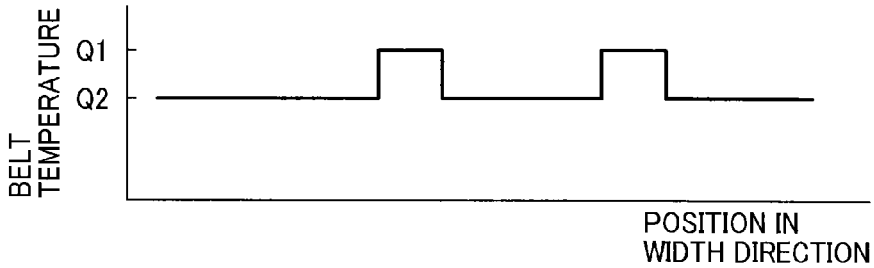
FIG. 10C is a temperature distribution of an area of the fixing belt corresponding to a middle portion of the sheet.
Figure 10D:
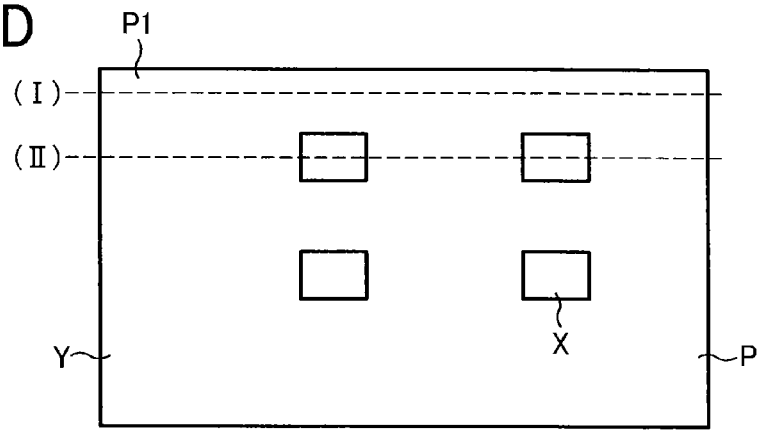
FIG. 10D is a plan view of the sheet.

FIGS. 10A to 10D relate to an embodiment to deal with the above-described challenge. FIG. 10A is a front view of a heater 23. FIG. 10B is a chart of a temperature distribution of an area of a fixing belt 21 corresponding to a leading end portion of a sheet P (temperature distribution at an area corresponding to line I of FIG. 10D). FIG. 10C is a temperature distribution of an area of the fixing belt 21 corresponding to a middle portion of the sheet P (temperature distribution of an area corresponding to line II of FIG. 10D). FIG. 10D is a plan view of the sheet P having image areas X and a non-image area Y.

To deal with the above-described challenge, in the present embodiment, as illustrated in FIGS. 10A to 10D, when it is determined that the separability of the sheet P decreases, a leading end portion P1 of the sheet P in a sheet feed direction is intermittently heated in the width direction of the sheet P. The leading end portion P1 described herein refers to an extent of several millimeters to approximately 10 mm at maximum from the leading edge of the sheet P.

The leading end portion P1 is usually in the non-image area Y. Accordingly, the area of the fixing belt 21 corresponding to the leading end portion P1 of the sheet P is usually heated to the second target temperature Q2 like the area corresponding to the non-image area Y at the middle portion of the sheet illustrated in FIG. 10C. For the present embodiment, as illustrated in FIG. 10B, the area of the fixing belt 21 corresponding to the leading end portion P1 of the sheet P is heated to a temperature Qh, which is higher than the normal temperature, i.e., the second target temperature Q2, intermittently in the width direction. As a result, high-temperature areas are intermittently formed in the leading end portion P1 of the sheet P. Since the high-temperature areas of the leading end portion P1 of the sheet P contain smaller amounts of moisture than the other areas, the leading end portion P1 of the sheet P is deformable in a wave form. As a result, even when the sheet P is less separable like a thin sheet, the leading end portion P1 can have stiffness, thus enhancing the separability of the sheet P from the fixing belt 21 by the separation member 41.

For such a configuration, even if the temperature of the high-temperature areas of the leading end portion P1 of the sheet P goes beyond 100 degrees C., it is substantially meaningless. Therefore, the heating temperature Qh of the area of the fixing belt 21 corresponding to the leading end portion P1 of the sheet P is preferably set so that the temperature of the high-temperature areas of the leading end portion P1 of the sheet P is not greater than 100 degrees C.

Next, another embodiment of this invention to deal with a challenge similar to the above-described embodiment of FIGS. 10A to 10D is described with reference to FIGS. 11A to 11D.

Figure 11A:
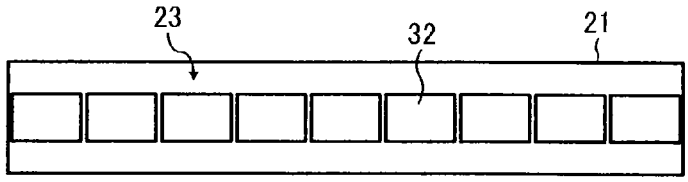
FIG. 11A is a front view of a heater according to an embodiment of the present invention.
Figure 11B:
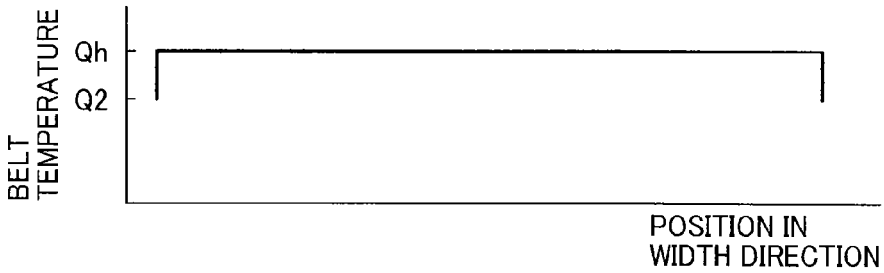
FIG. 11B is a chart of a temperature distribution of an area of a fixing belt corresponding to a leading end portion of a sheet.
Figure 11C:
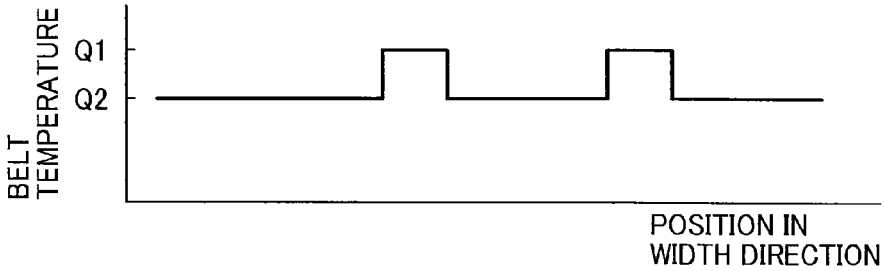
FIG. 11C is a temperature distribution of an area of the fixing belt corresponding to a middle portion of the sheet.
Figure 11D:
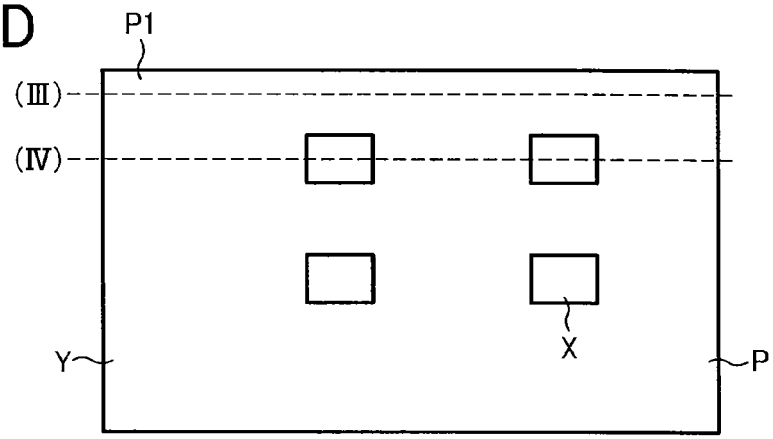
FIG. 11D is a plan view of the sheet.

FIG. 11A is a front view of a heater 23. FIG. 11B is a chart of a temperature distribution of an area of a fixing belt 21 corresponding to a leading end portion of a sheet P (temperature distribution at an area corresponding to line III of FIG. 11D). FIG. 11C is a temperature distribution of an area of the fixing belt 21 corresponding to a middle portion of the sheet P (temperature distribution of an area corresponding to line IV of FIG. 11D). FIG. 11D is a plan view of the sheet P having image areas X and a non-image area Y.

For this embodiment, when it is determined that the separability of the sheet P decreases, an entire area of the leading end portion P1 of the sheet P in the width direction is heated to a temperature higher than the other non-image area. Hence, the area of the fixing belt 21 corresponding to the leading end portion P1 of the sheet P is heated entirely in the width direction up to a temperature Qh higher than a second target temperature Q2 serving as a normal temperature.

Figure 12:
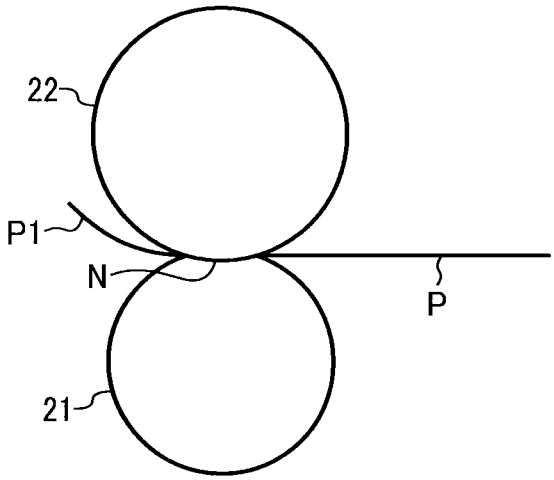
FIG. 12 is a side view of a fixing device according to an embodiment of the present invention.

As described above, by raising the entire area of the leading end portion P1 of the sheet P in the width direction to a higher temperature than the other non-image area Y, as illustrated in FIG. 12, the entire area of the leading end portion P1 of the sheet P in the width direction deforms in a direction to wind around a pressure roller 22. As a result, even when the sheet P is, e.g., a less-separable, thin sheet, a separation force in a direction away from the fixing belt 21 acts on the sheet having just emerged from the nipping portion N, thus enhancing the separability of the sheet P and preventing occurrence of a sheet jam.

As described above, for the above-described embodiments illustrated in FIGS. 10A to 10D and FIGS. 11A to 11D, the leading end portion P1 of the sheet P is heated to a temperature higher than the other non-image area Y. However, such control is performed when the heating controller 26 determines that the separability of the sheet P is relatively low from an input index indicating the separability of the sheet P. Examples of the index indicating the separability of the sheet P described herein include sheet information, such as the thickness, type, size, or grammage of the sheet P and external environment information, such as temperature and humidity. The heating controller 26 can determine whether or not the separability of the sheet P is relatively low from any one or a combination of at least two of the above-listed indexes.

Next, another embodiment of this invention is described below.

Figure 13A:
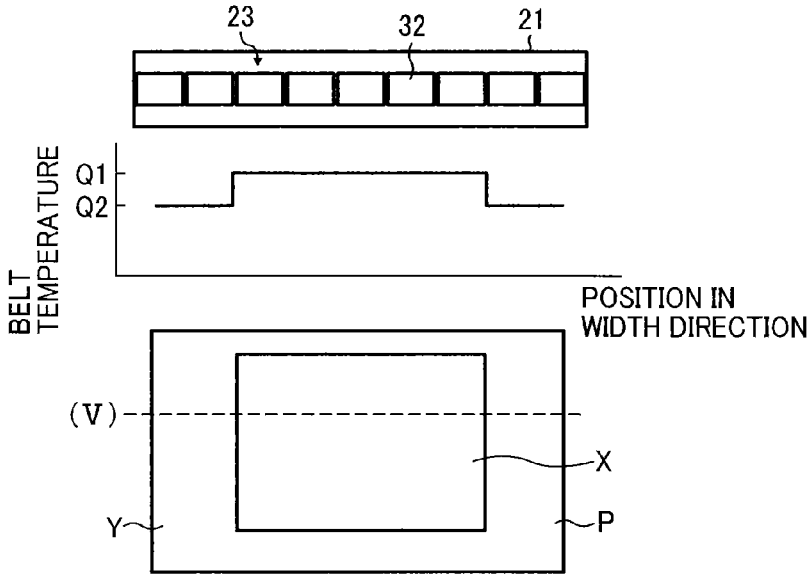
FIG. 13A is a front view of a heater according to an embodiment of the present invention, a chart of a temperature distribution of a fixing belt, and a plan view of a sheet.

As illustrated in FIG. 13A, for an image having margins at both ends in the width direction of a sheet P, the temperature of an image area X at a middle portion in the width direction is higher, and the temperature of a non-image area Y at each end in the width direction is lower. In such a case, during heating of the heater 23, the temperature of an area of the fixing belt 21 corresponding to the image area X becomes a first target temperature Q1, and the temperature of an area of the fixing belt 21 corresponding to the non-image area Y becomes a second target temperature Q2.

Figure 13B:
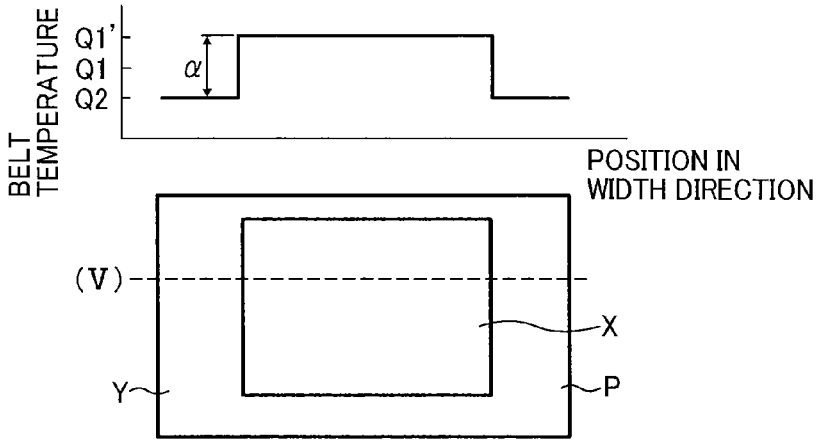
FIG. 13B is a chart of a temperature distribution of the fixing belt and a plan view of the sheet.
Figure 13C:
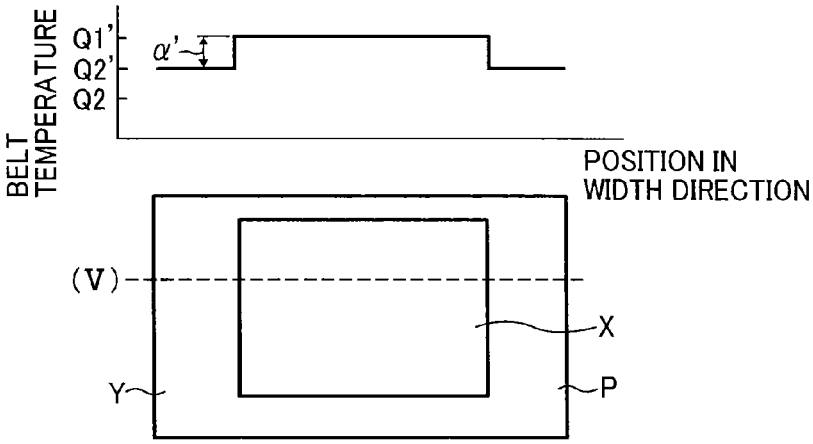
FIG. 13C is a chart of a temperature distribution of the fixing belt and a plan view of the sheet.

When the image is continuously printed (for example, on approximately 50 sheets), as illustrated in FIG. 13B, the temperature of the area of the fixing belt 21 corresponding to the image area X may be raised to Q1', thus increasing the temperature difference $\alpha$ between the area of the fixing belt 21 corresponding to the image area X and the area of the fixing belt 21 corresponding to the non-image area Y. To prevent occurrence of wrinkles of the sheet P, the pressure roller 22 is designed so that the size of an outer diameter of each end in the longitudinal direction is greater than the size of an outer diameter of a middle portion in the longitudinal direction. However, if the temperature difference $\alpha$ in the fixing belt 21 is relatively great, a temperature difference corresponding to the temperature difference $\alpha$ may also occur in the pressure roller 22. As a result, a difference in thermal expansion may reduce the difference of the outer diameter between the middle portion and each end of the pressure roller 22, thus causing a reduced sheet feed performance, such as occurrence of wrinkles.

To deal with such a challenge, for the present embodiment, the temperature difference $\alpha$ is detected with the second sensor 28 illustrated in FIG. 2, and the detected value is input to the heating controller 26. If the temperature difference $\alpha$ is greater than a predetermined value, the heating controller 26 increases the outputs of heat generators 32 corresponding to the non-image area Y to raise the temperature of the entire non-image area Y of the fixing belt 21 to a temperature Q2' which is higher than the second target temperature Q2 serving as normal temperature. Such a configuration can reduce the temperature difference $\alpha'$ between the area of the fixing belt 21 corresponding to the image area X and the area of the fixing belt 21 corresponding to the non-image area Y. As a result, deformation of the pressure roller 22 due to the difference in thermal expansion can be suppressed, thus preventing a reduction in sheet feed performance, such as occurrence of wrinkles.

For this embodiment, to determine the temperature differences $\alpha$ and $\alpha'$, the temperature is measured over the entire area of the sheet P in the width direction of the sheet P. Hence, the second sensor 28 is disposed at plural positions in the width direction of the sheet, and more preferably disposed opposing plural areas of the fixing belt 21 heated by the respective heat generators 32.

In each of the above-described embodiments, the area of the fixing belt 21 corresponding to the non-image area Y is temporarily shifted to a temperature higher than the normal temperature (second target temperature Q2) based on information, other than image information, input to the heating controller 26, such as the toner density (the above-described embodiment illustrated in, e.g., FIGS. 6 and 7), the separability of the sheet P (the above-described embodiments illustrated in FIGS. 10A to 10D and FIGS. 11A to 11D), or the temperature difference of the fixing belt 21 (the above-described embodiment illustrated in FIGS. 13A to 13D). Such a configuration can obtain various effects of, e.g., preventing background staining of the sheet, occurrence of a sheet jam, and a reduction in sheet feed performance of the pressure roller 22, thus allowing enhancement of the multifunctionality of the fixing device 14. Such an area of the fixing belt 21 shifted to a high temperature may be an entire or partial area corresponding to the non-image area of the fixing belt 21 (see FIGS. 9A and 9B).

For the above-described embodiments, the area of the fixing belt 21 corresponding to the non-image area Y is shifted to a temperature higher than the normal temperature. It is to be noted that, based on the information other than image information, the area of the fixing belt 21 corresponding to the non-image area Y may be shifted to a temperature lower than the normal temperature, thus allowing further enhancement of the multifunctionality of the fixing device 14.

For the above-described embodiments, the fixing belt 21 is described as an example of the fixing rotary body, and the heater 23 to heat the fixing belt 21 from the inner circumferential side of the fixing belt 21 is described as an example of the heating unit. It is to be noted that the fixing rotary body or the heating unit is not limited to the above-described example.

Figure 14:
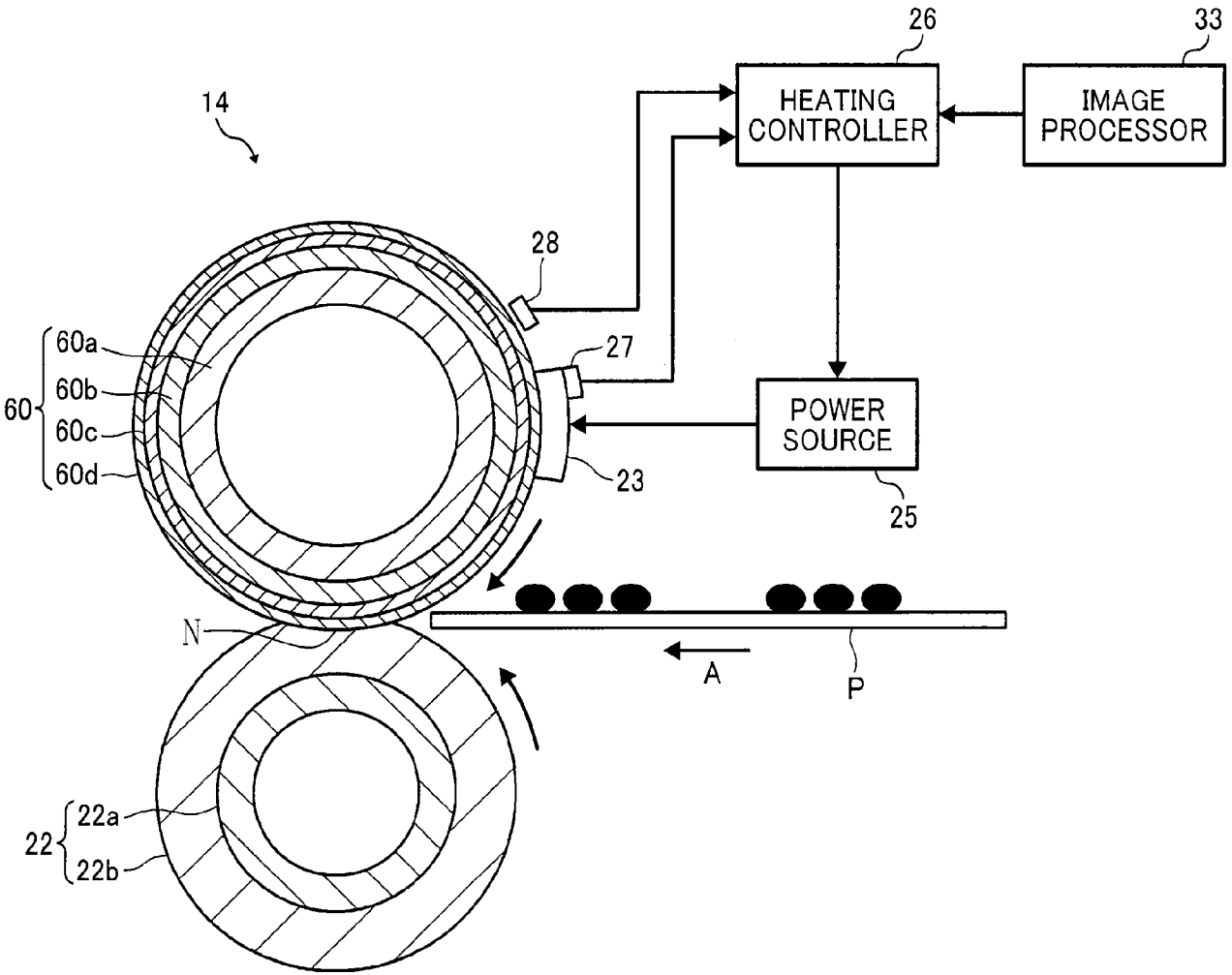
FIG. 14 is a cross-sectional view of a fixing device according to an embodiment of the present invention.

For example, in an embodiment of this invention, as illustrated in FIG. 14, a fixing roller 60 is employed as the fixing rotary body, and a heater 23 to heat the fixing roller 60 from the outer circumferential side of the fixing roller 60 is employed as the heating unit. In this embodiment, the fixing roller 60 has a core metal 60*a*, a heat insulation layer 60*b*, a heat conductive layer 60*c*, and a release layer 60*d*. The core metal 60*a* includes, e.g., aluminum and has an outer diameter of approximately 40 mm and a thickness of approximately 1 mm. The heat insulation layer 60*b* coats an outer circumferential surface of the core metal 60*a*. The heat conductive layer 60*c* coats an outer circumferential surface of the heat insulation layer 60*b*. The release layer 60*d* coats an outer circumferential surface of the heat conductive layer 60*c*.

The heat insulation layer 60*b* includes, e.g., silicone rubber and has a thickness of approximately 3 mm. In some embodiments, to enhance the insulation performance of the heat insulation layer 60*b*, the heat insulation layer 60*b* includes foamed silicone rubber which radiates less heat.

The heat conductive layer 60*c* includes, e.g., nickel. Examples of material of the heat conductive layer 60*c* include not only nickel but also iron-based alloy such as stainless, metal such as aluminum or copper, and graphite sheet. Any suitable material having a heat conductivity higher than at least the heat insulation layer 60*b* can be used as the material of the heat conductive layer 60*c*. The heat conductive layer 60*c* having such a high heat conductivity can suppress partial fluctuations in the surface temperature of the fixing roller 60 due to uneven heating of the heater 23. In addition, the heat conductive layer 60*c* can raise the temperature of an area slightly greater than an area in which the heater 23 is disposed, thus allowing covering a non-overlapping area between the heater 23 and an image. Such a configuration increases the degree of freedom in setting, e.g., the size or space of multiple heat generators 32 constituting the heater 23.

The heat conductive layer 60*c* includes, e.g., fluorine resin such as perfluoro-alkoxyalkane (PFA) or polytetrafluoroethylene (PTFE) and has a thickness of approximately 5 μm and approximately 30 μm.

A fixing device 14 illustrated in FIG. 14 includes, e.g., a power source 25, a heating controller 26, a first sensor 27, and a second sensor 28. The power source 25 supplies power to the heater 23. The heating controller 26 controls the heater 23 in accordance with information obtained from an image processor 33. The first sensor 27 detects the temperature of the heater 23. The second sensor 28 detects the temperature of the fixing roller 60. The configurations of the power source 25, the heating controller 26, the first sensor 27, and the second sensor 28 are basically similar to, even if not the same, the above-described embodiments, and therefore redundant descriptions thereof are omitted here.

In FIG. 14, the heater 23 contacts an outer surface of the fixing roller 60. It is to be note that the configuration of the heater 23 is not limited to the configuration illustrated in FIG. 14. For example, a non-contact-type heating unit may be used that employs an induction heating (IH) system with a coil and an inverter. For such an IH system, multiple heating coils may be arranged in an axial direction of the fixing roller 60, or multiple members for canceling magnetic flux may be arranged in the axial direction of the fixing roller 60, thus allowing control of heating areas or heating amounts.

Figure 15:
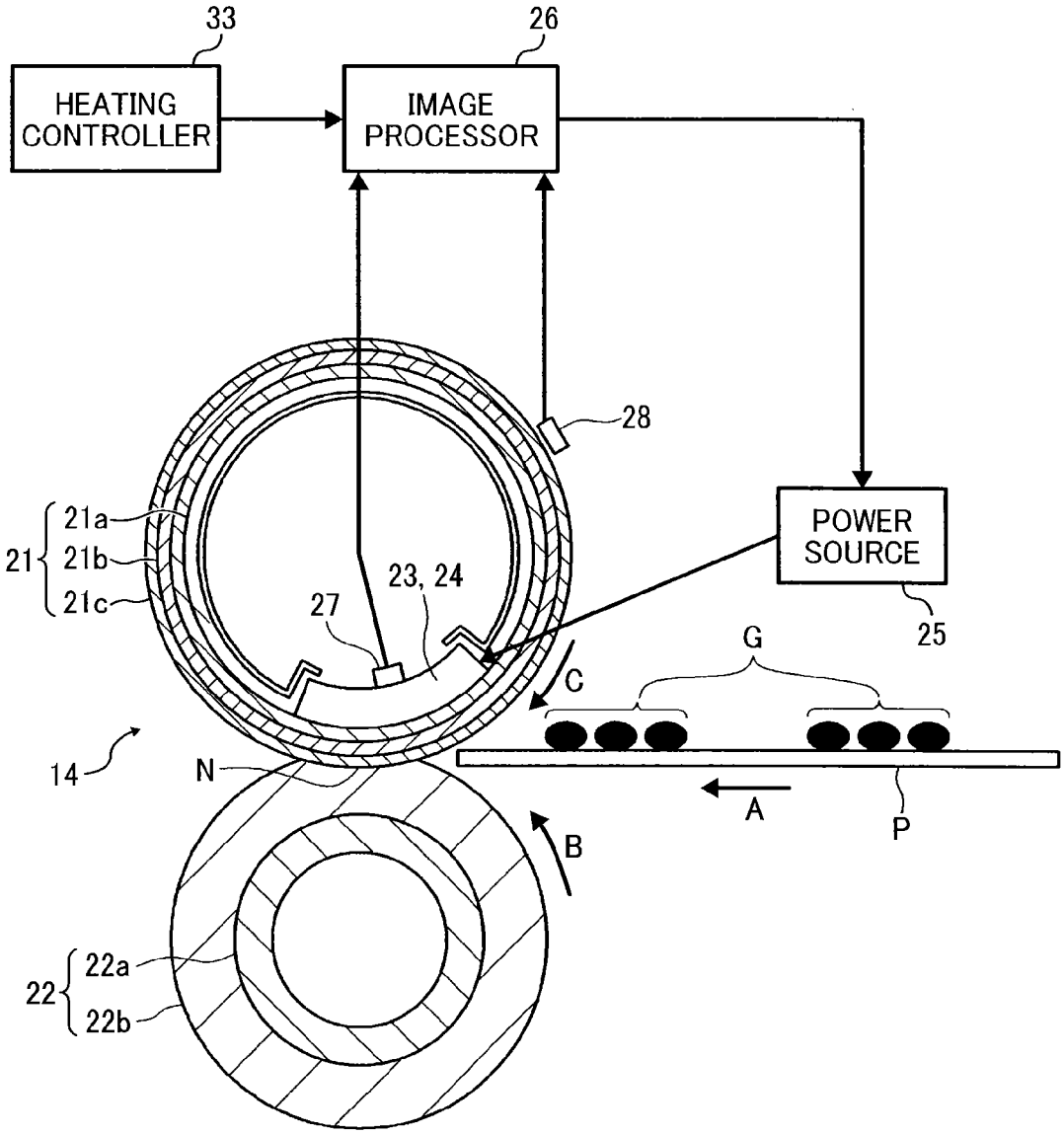
FIG. 15 is a cross-sectional view of a fixing device according to an embodiment of the present invention.

In addition, as illustrated in FIG. 15, in the fixing device illustrated in FIG. 2, the heater 23 can be disposed at a portion forming the nipping portion N within the fixing belt 21. In such a case, the heater 23 serving as the heating member also functions as the nip formation member 24.

An image forming apparatus according to embodiments of this invention is not limited to the monochromatic image forming apparatus illustrated in FIG. 1.

Figure 16:
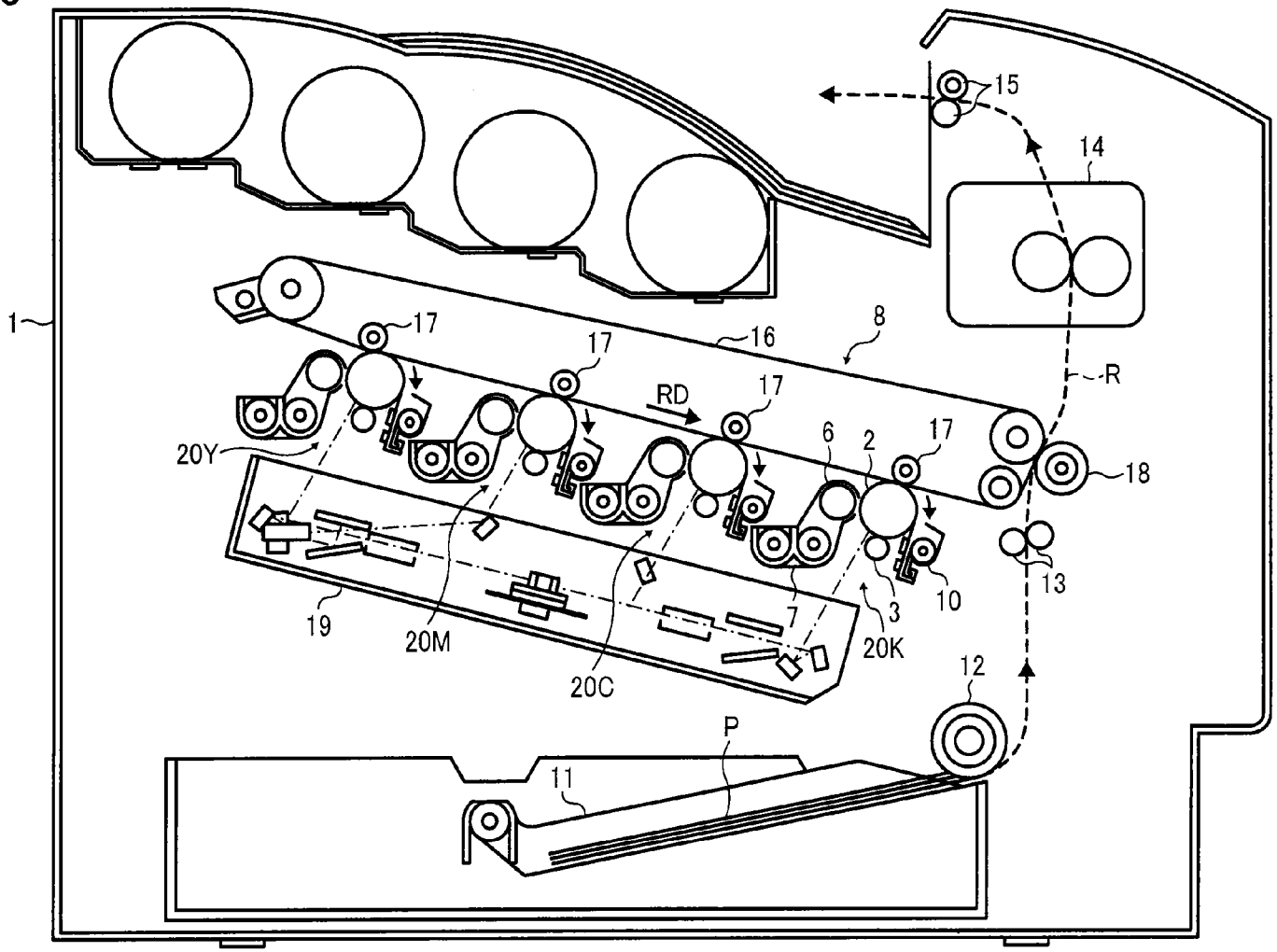
FIG. 16 is a schematic view of an image forming apparatus according to an embodiment of the present invention.

For example, a fixing device according to an embodiment of the present invention is mounted in a color image forming apparatus as illustrated in FIG. 16. The color image forming apparatus illustrated in FIG. 16 includes four process units 20Y, 20M, 20C, and 20K detachably attached relative to an apparatus body 1. The process units 20Y, 20M, 20C, and 20K have similar, even if not the same, configurations except for containing different color developers of yellow (Y), magenta (M), cyan (C), and black (K) corresponding to color separation components of color image. For example, each of the process units 20Y, 20M, 20C, and 20K includes, e.g., a photoreceptor 2, a charging roller 3, a development unit 7, and a cleaner 10. The charging roller 3 charges an outer surface of the photoreceptor 2. The development unit 7 has a development roller 6, and the cleaner 10 has a cleaning blade 9 to clean the outer surface of the photoreceptor 2.

A transfer unit 8 is disposed above the process units 20Y, 20M, 20C, and 20K and includes an intermediate transfer belt 16, plural primary transfer rollers 17, and a secondary transfer roller 18. An exposure unit 19 is disposed below the process units 20Y, 20M, 20C, and 20K.

Next, a basic imaging operation of the image forming apparatus illustrated in FIG. 16 is described below.

When imaging operation is started, the photoreceptor 2 of each of the process units 20Y, 20M, 20C, and 20K is driven for rotation and the charging roller 3 uniformly charges the outer surface of the photoreceptor 2 at a certain polarity. The exposure unit 19 irradiates laser light onto the charged surface of each photoreceptor 2 to form an electrostatic latent image on the charged surface. At this time, image information for exposing each photoreceptor 2 is single-color image information obtained by separating a desired full-color image into single-color information on yellow, cyan, magenta, and black. Each development unit 7 supplies toner onto the electrostatic latent image formed on the corresponding photoreceptor 2, and as a result, the electrostatic latent image is visualized (become visible) as a toner image.

On the other hand, when imaging operation is started, the intermediate transfer belt 16 is driven to rotate in a direction indicated by arrow RD in FIG. 16. When color toner images on the respective photoreceptors 2 arrive at the corresponding primary transfer rollers 17 with the rotation of the photoreceptors 2, the toner images on the photoreceptors 2 are sequentially superimposed one on another on the intermediate transfer belt 16 by a transfer electric field formed between the primary transfer rollers 17 and the photoreceptors 2. As a result, a full-color image is borne on an outer surface of the intermediate transfer belt 16. After the transfer of the toner image, the outer surface of each photoreceptor 2 is cleaned by the cleaner 10 and diselectrified by the diselectrification device.

At a lower portion of the apparatus body 1, a feed roller 12 starts rotation to feed sheets P sheet by sheet from a feed tray 11. After the sheet P fed to a transport path R is temporarily stopped by registration rollers 13, the registration rollers 13 feed the sheet P to a portion between the secondary transfer roller 18 and the intermediate transfer belt 16 at a proper timing. By a transfer electric field generated between the secondary transfer roller 18 and the intermediate transfer belt 16, the full-color image on the intermediate transfer belt 16 is collectively transferred onto the sheet P at a transfer nipping portion. Then, the sheet P is fed to the fixing device 14, and the fixing device 14 fixes the full-color toner image on the sheet P. The output rollers 15 discharge the sheet P to the outside of the apparatus body 1.

The above description relates to image forming operation for forming a full color image on a recording material. In other image forming operation, a single color image can be formed by any one of the process units 20Y, 20M, 20C, and 20K, or a composite color image of two or three colors can be formed by two or three of the process units 20Y, 20M, 20C, and 20K.

In addition, an image forming apparatus according to an embodiment of the present invention is not limited to that of any of the above-described embodiments. For example, the image forming apparatus is not limited to any other type of printer, a copier, a facsimile machine, or a multi-functional peripheral having at least one of the foregoing capabilities.

The above-described embodiments are illustrative and do not limit the present invention. Thus, numerous additional modifications and variations are possible in light of the above teachings. For example, elements at least one of features of different illustrative and embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A fixing device comprising:

a fixing rotary body;

an opposed member opposing the fixing rotary body to form a nipping portion between the opposed member and the fixing rotary body;

a heater to heat the fixing rotary body, the heater including plural heat generators arranged in a width direction of a recording medium fed to the nipping portion; and a heating controller to separately control outputs of the heat generators, wherein, when the recording medium fed to the nipping portion has an image area and a non-image area, the heating controller controls the outputs of the heat generators based on image information so that a first heat generator of the heat generators corresponding to the image area is higher in temperature and a second heat generator of the heat generators corresponding to the non-image area is lower in temperature, and wherein, based on information other than the image information, the heating controller temporarily shifts an area of the fixing rotary body corresponding to the non-image area to a temperature differing from a normal temperature.

2. The fixing device of claim 1, wherein the information other than the image information is an adherence amount of toner adhering to the non-image area before fixing of an image on the recording medium, and when the adherence amount of toner is greater than a threshold value, the heating controller controls the second heat generator to heat the area of the fixing rotary body corresponding to the non-image area to a higher temperature than the normal temperature.

3. The fixing device of claim 1, wherein the information other than the image information is an index indicating a separability of the recording medium from the fixing rotary body, and when the index indicates a lower separability, the heater heats an area of the fixing rotary body corresponding to a leading end portion of the recording medium to a higher temperature than the normal temperature.

4. The fixing device of claim 3, wherein the heater heats the area of the fixing rotary body corresponding to the leading end portion of the recording medium to the higher temperature intermittently in the width direction of the recording medium.

5. The fixing device of claim 3, wherein the heater heats the area of the fixing rotary body corresponding to the leading end portion of the recording medium to the higher temperature entirely in the width direction of the recording medium.

6. The fixing device of claim 1, wherein the information other than the image information is a temperature difference between the image area and the non-image area, and when the temperature difference is greater than a threshold value, the heater heats the area of the fixing rotary body corresponding to the non-image area to a higher temperature than the normal temperature.

7. The fixing device of claim 6, wherein the temperature difference is formed by continuous feeding of plural recording media.

8. The fixing device of claim 1, wherein the normal temperature is a temperature set as a default when the second heat generator heats the area of the fixing rotary body corresponding to the non-image area.

9. An image forming apparatus comprising the fixing device according to claim 1.

* * * * *